US006851568B2

(12) United States Patent
Herrmann

(10) Patent No.: US 6,851,568 B2
(45) Date of Patent: Feb. 8, 2005

(54) LID-SEAL OF METAL CONTAINER FOR POWDERED FOOD OR OTHER MATERIAL

(75) Inventor: Thomas Bier Herrmann, Porto Alegre (BR)

(73) Assignee: Renner Herrmann S.A. (BR)

( * ) Notice: Subject to any disclaimer, the term of this patent is extended or adjusted under 35 U.S.C. 154(b) by 28 days.

(21) Appl. No.: 10/304,142

(22) Filed: Nov. 25, 2002

(65) Prior Publication Data

US 2003/0075545 A1 Apr. 24, 2003

Related U.S. Application Data

(63) Continuation of application No. 09/857,317, filed as application No. PCT/BR00/00128 on Oct. 31, 2000, now abandoned.

(30) Foreign Application Priority Data

Mar. 21, 2000 (BR) ..... 0001936

(51) Int. Cl.[7] ..... B65D 17/34
(52) U.S. Cl. ..... 220/270; 220/276
(58) Field of Search ..... 220/270, 276, 220/214

(56) References Cited

U.S. PATENT DOCUMENTS 3,163,317 A * 12/1964 Biedenstein et al. ..... 220/270
4,393,979 A * 7/1983 Ball et al. ..... 220/270
5,054,642 A * 10/1991 Yoshida ..... 220/276
5,395,005 A * 3/1995 Yoshida ..... 220/359.2
6,332,552 B1 * 12/2001 Iwasaki et al. ..... 220/276

* cited by examiner

*Primary Examiner*—Jes F. Pascua
(74) *Attorney, Agent, or Firm*—Ostrolenk, Faber, Gerb & Soffen, LLP

(57) ABSTRACT

A lid-seal for a metal container constituted by fixing, through a beading process, on the upper edge of a metal container (1) made of sheet metal, an assembly formed by a plastic membrane (2) and a stamped metal ring (3). The plastic membrane (2) has a peripheral portion (9), followed internally by a recess having therein a ring-like recess (10) and a perimetral ring-like reinforcement (11) and with a lower ring-shaped thin breaking line (12) which breaks when pulled, after the breaking of the short breaking portion (13) of the incorporated pulling ring (14). The stamped metal ring (3) has a flat inner section (4) with a central circular opening (5) with the inner edge beaded inwards (6) and an elevation to form an upper bed (7) and a peripheral edge turned downwards (8) so that, jointly with the peripheral portion (9) of the membrane (2) it can be beaded in the container (1). The disclosed lid-seal assures the necessary sealing and the consequent quality of the packaged product, and the certainty that there will not be any possibility of hurting the fingers upon opening.

11 Claims, 6 Drawing Sheets

LID-SEAL OF METAL CONTAINER FOR POWDERED FOOD OR OTHER MATERIAL

This is a continuation of application Ser. No. 09/857,317, filed Jun. 4, 2001, now abandoned, which is a national stage entry of PCT/BR00/00128 filed Oct. 31, 2000.

BACKGROUND OF THE INVENTION

1. Field of the Invention

This is related to a patent of invention for an improvement in a lid-seal for a metal containers for a powdered foodstuff or other material, the development of which has as a purpose to develop a lid-seal which assures the necessary tightness, the consequent quality of the packaged product, and the conviction that there will be no possibility of harming the fingers, upon its opening.

2. Related Art

Several types of foodstuff are known which, in order to increase their useful life, allow the use of a process for the elimination of water from their composition, so that they may be converted into powder, such as powdered milk and other products, avoiding the contact with aerobic bacteria, and may, many times, be kept at room temperature for several years. Their packaging material is many times made out of tinned iron sheet which is cut, calendered and welded, with the bottom being sealed by a beaded disc of the same material, sealed with an aluminum sheet together with a ring which serves as a pressure lead, known as "Easy-open," with said seal allowing the foodstuff to be totally sealed, and opened only for final consumption.

The above mentioned cylinder shaped metal packaging and respective seals are used in a process well known for decades which is used by different manufacturers of powdered milk, milk products, chocolate flavors, and others products.

Some manufacturers use a cylindrical packaging material made out of semi-rigid plastic material which, after the introduction of the product within it, receives an aluminum laminated seal which is hot sealed, receiving a flexible plastic material secondary cover or over-lid, fitted under pressure which, after taking the seal off, shall be used as the lid of the package, a cheaper solution than the one previously mentioned. The problem is in the possibility of the welding used for sealing not being perfect, allowing the entering of aerobic bacteria which could affect the quality of the product.

SUMMARY OF THE INVENTION

In the patent now requested, the improvement made in the lid-seal, for metal packages for powdered food or others material, is constituted by a construction where the closing of the metal package or, as commonly known by the public, the can is made by an assembly formed by an injected plastic membrane (PEBD) with a peripheral border, an applied ring-like thin breaking line and an incorporated traction ring, plus an upper ring-like depression to receive a stamped laminar ring, made of metal sheet, the inner border of which is drawn and bent so that its cutting edge remains hidden, with the outside edge of said assembly fixed on the upper edge of the body of said packing material by a beading operation, with said laminar ring having an internal diameter slightly larger than the diameter of said thin line of the plastic membrane in order to act as a support and to help in the breaking of said line, when the user pulls the traction ring to open the package. The closing of the package will be made by the above mentioned plastic over-lid which is used with this type of package.

It should be noticed that the extracted portion upon the opening of the package is the central part of the plastic membrane, which does not offer any risk of cutting the fingers, and may be discarded without any other worries. Another advantage is in the face that, considering that there is no breaking of the metal part, there will be no oxidation.

As it is also possible to notice, the production cost of the above-described elements is substantially less than when aluminum laminate material is used, and the invention also increases the productivity, due to the automation of production, therefore helping the company in their constant search for production cost reduction.

BRIEF DESCRIPTION OF THE DRAWINGS

For a better understanding of the object of this patent, reference to the attached drawings will be made, where.

DETAILED DESCRIPTION

Figure 1:
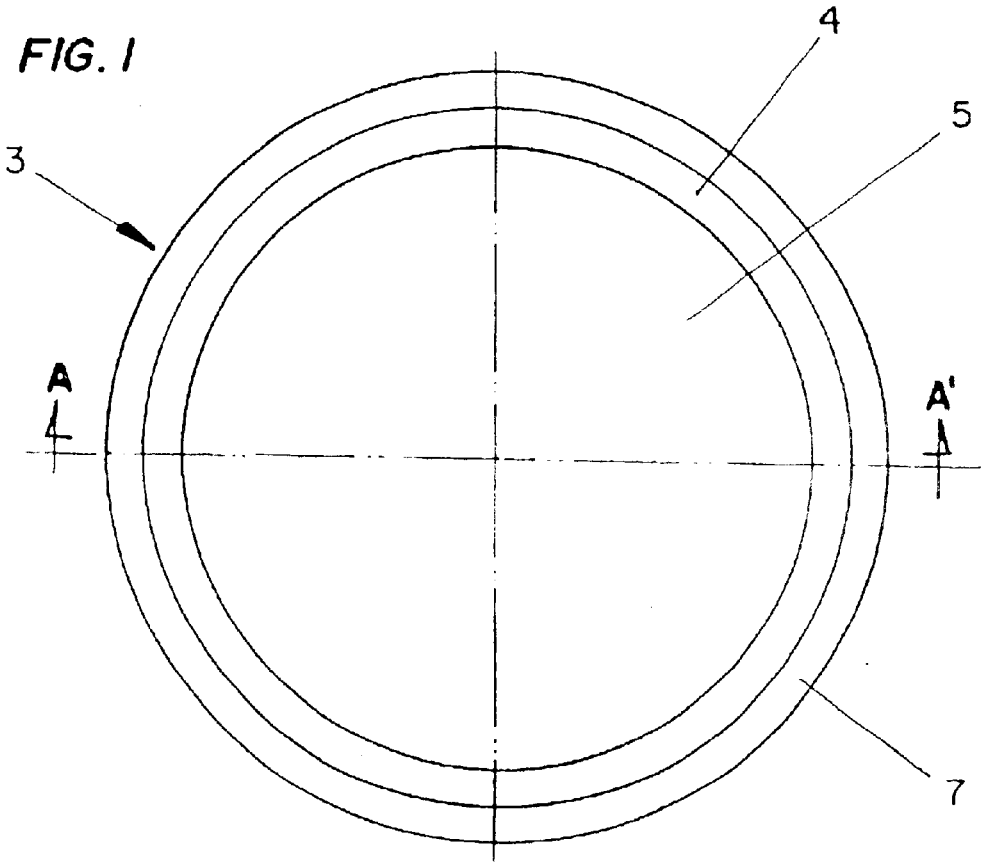
FIG. 1—shows an upper view of the laminar stamped metal ring.
Figure 2:
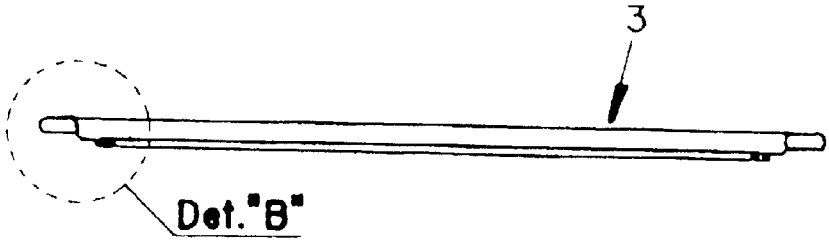
FIG. 2—shows a longitudinal cross section along the line A—A' of the stamped metal laminar ring.
Figure 3:
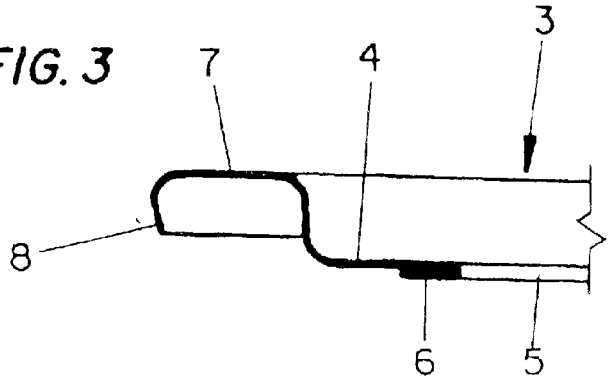
FIG. 3—shows a vertical cross section of the "B" detail of the stamped metal laminar ring.
Figure 4:
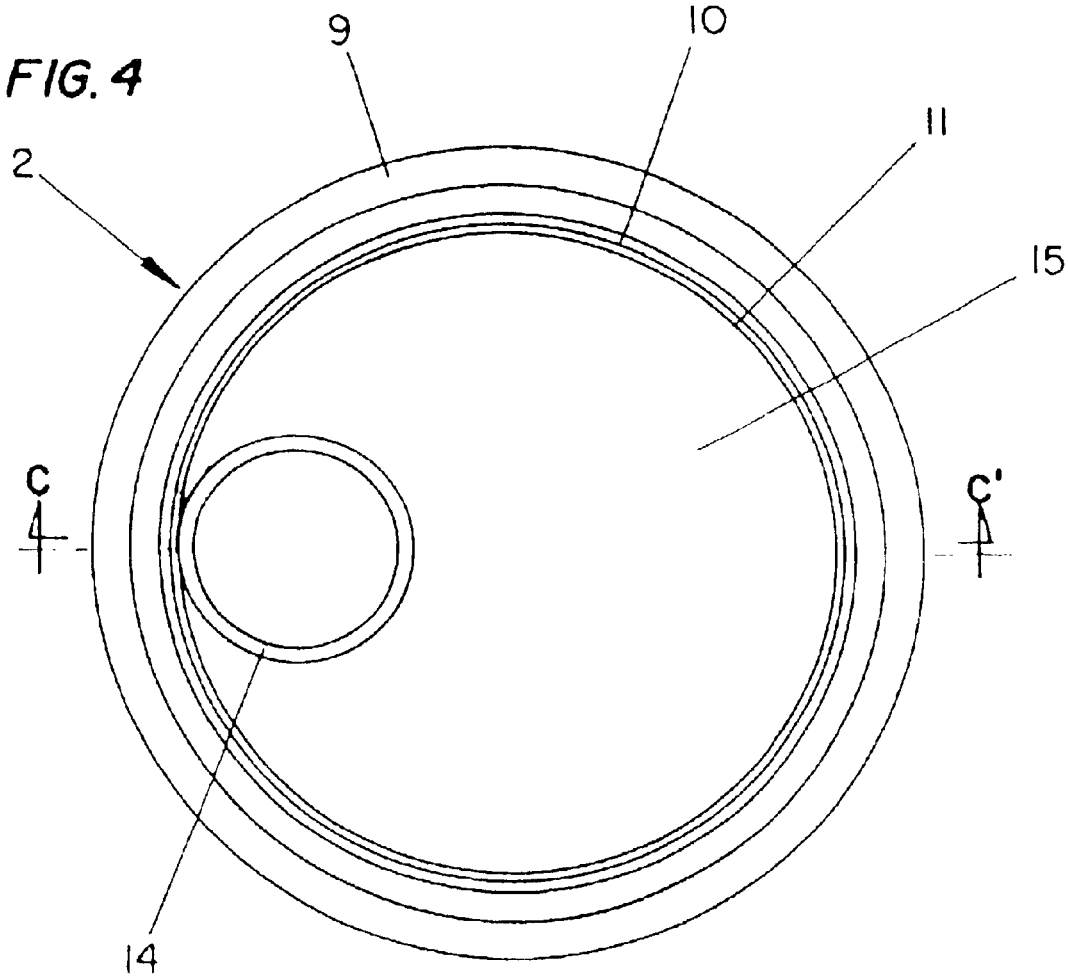
FIG. 4—shows an upper view of the injected plastic membrane, especially the incorporated pulling ring and the thin breaking line.
Figure 5:
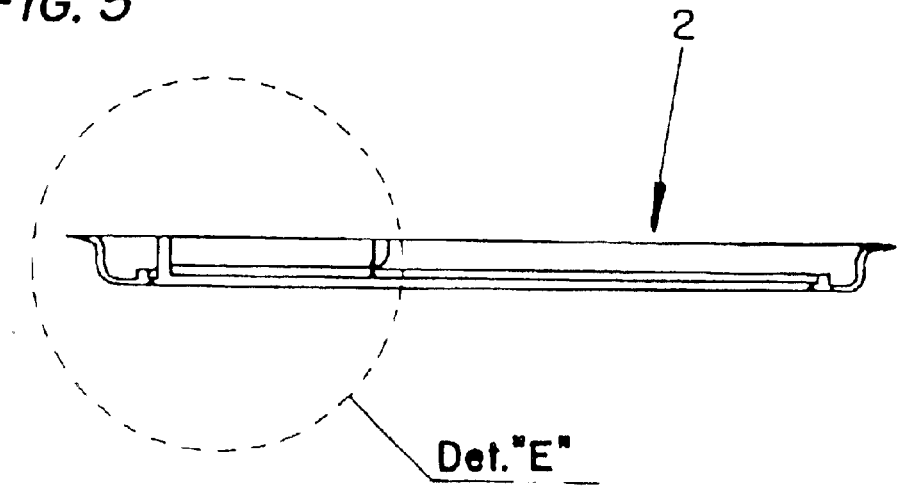
FIG. 5—shows the C—C' longitudinal line, the injected plastic membrane, specially the incorporated pulling ring.
Figure 6:
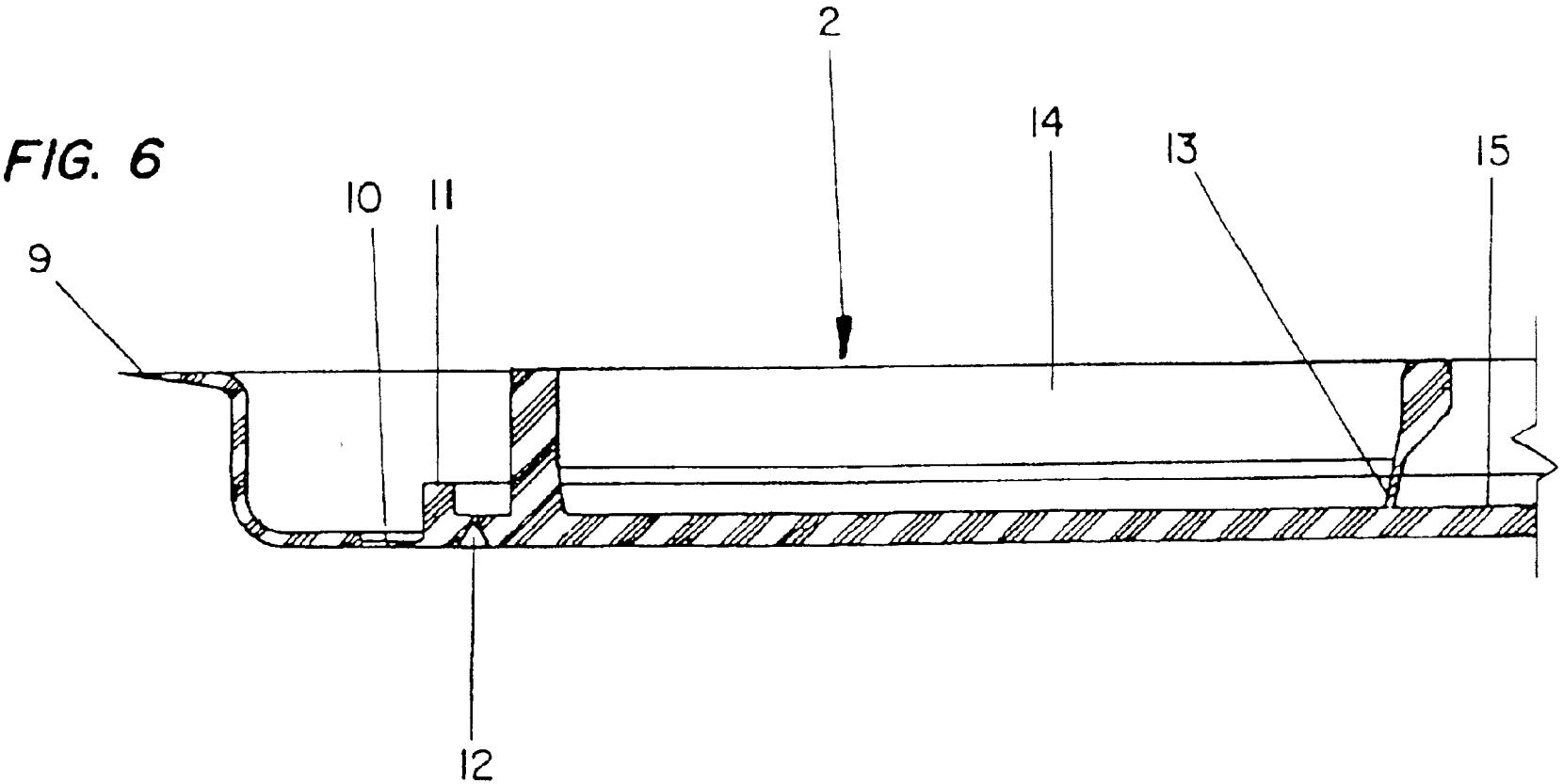
FIG. 6—shows the vertical cross section of detail "E" of the injected plastic membrane, noticing the incorporated pulling ring attached by a small breaking portion, the seat for said metal ring and the thin breaking line with a reinforcement along it.
Figure 7:
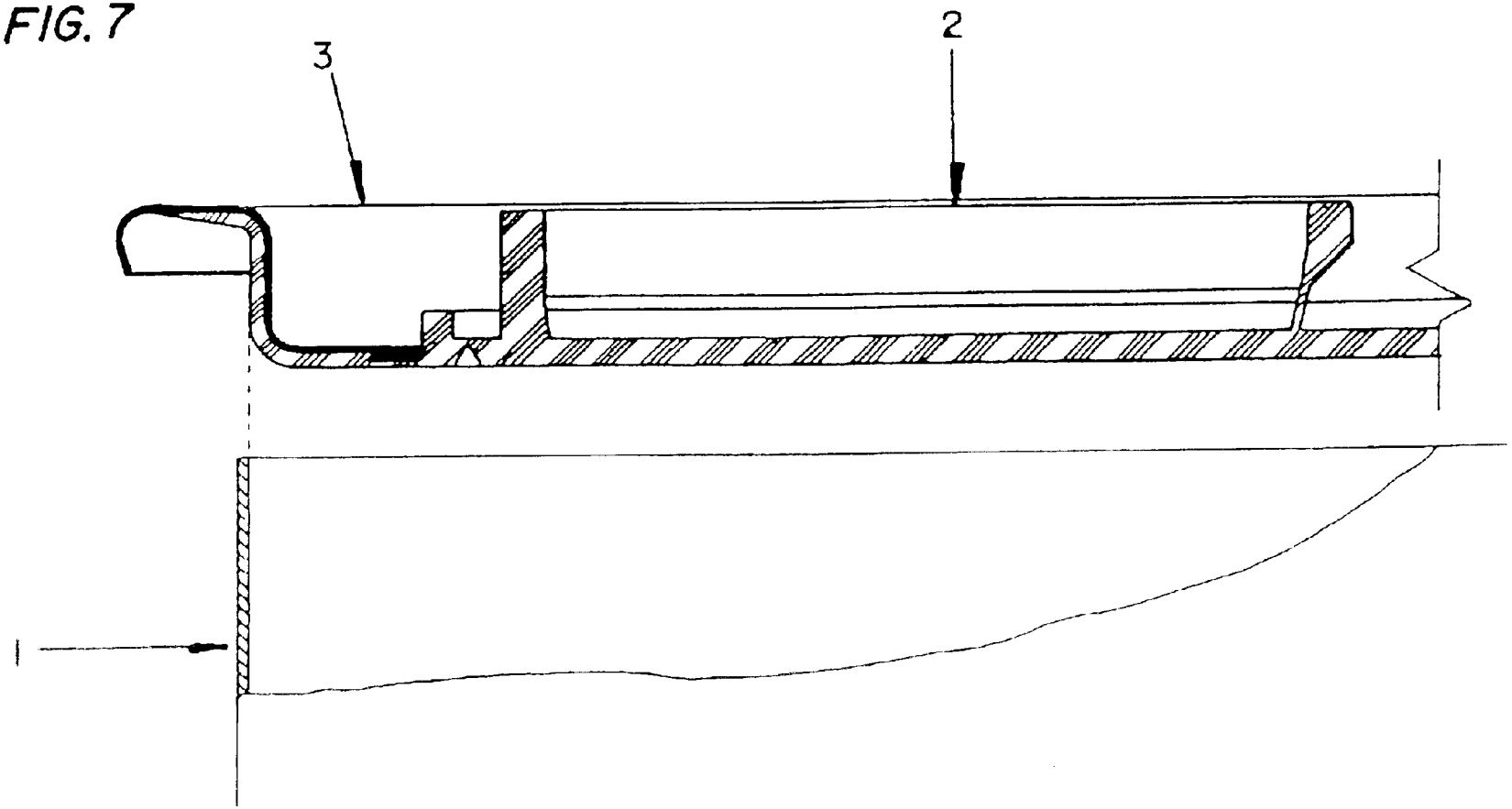
FIG. 7—shows a vertical cross section of the detail of the metal ring on the plastic membrane to be mounted on the mouth of the metal container, to be beaded.
Figure 8:
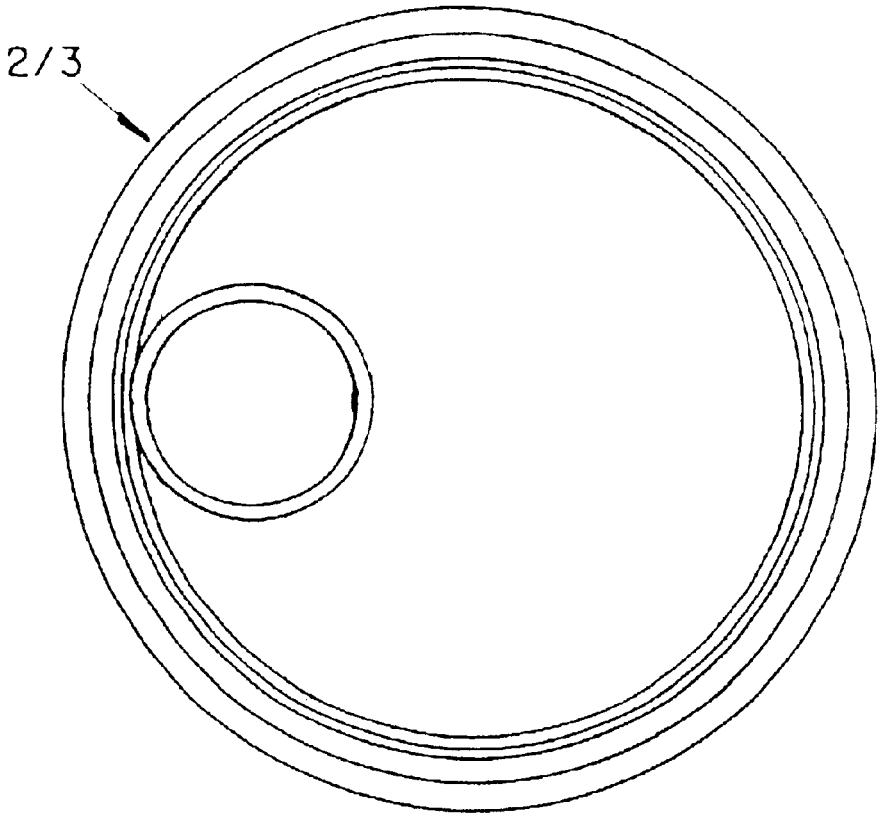
FIG. 8—shows, in an upper view, the metal container with tie plastic membrane and the beaded metal laminar ring.
Figure 9:
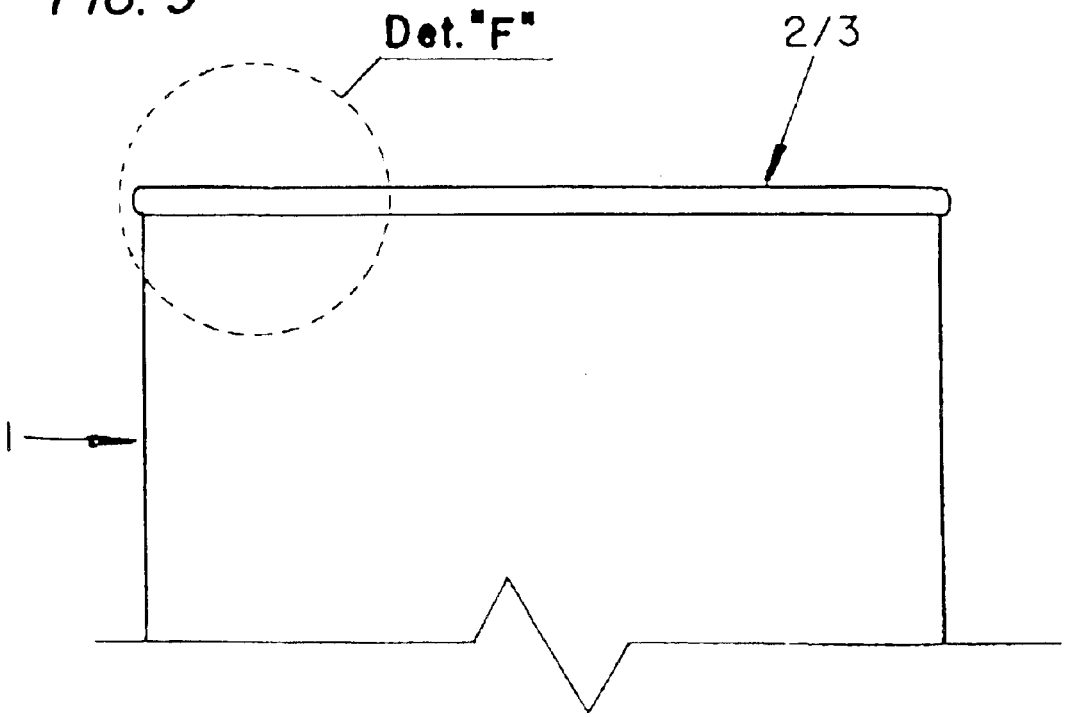
FIG. 9—shows a lateral view of the cylindrical metal container (or can) with the upper beading portion which fixes the ring and the membrane, sealing the container, FIG. 10—shows a partial cross section of the "F" detail, the plastic membrane which received the beaded metal laminar ring on the edge of the container sealing it.
Figure 10:
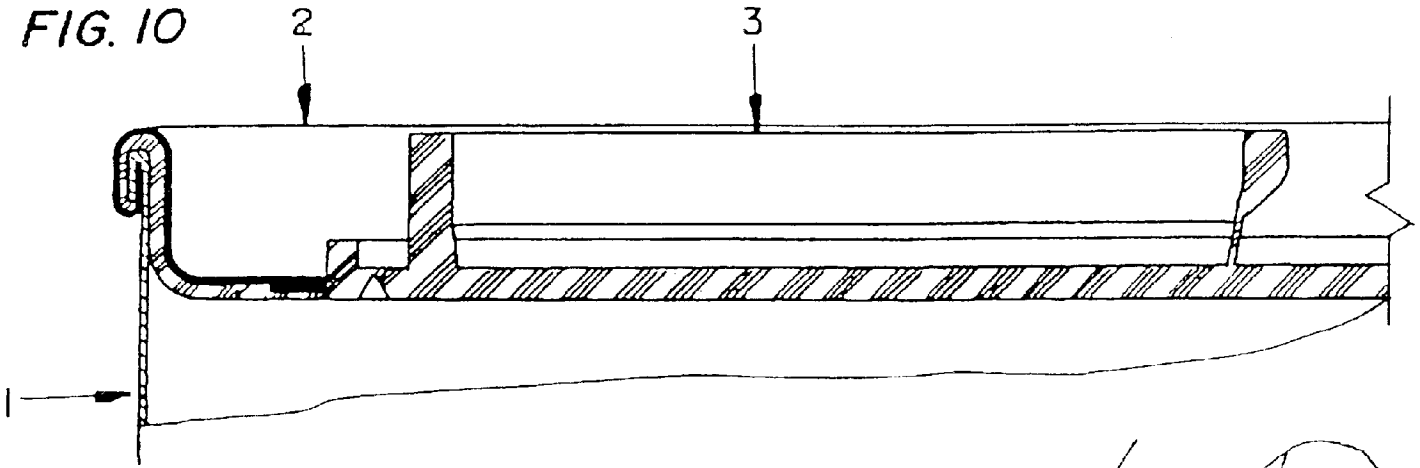
Figure 11:
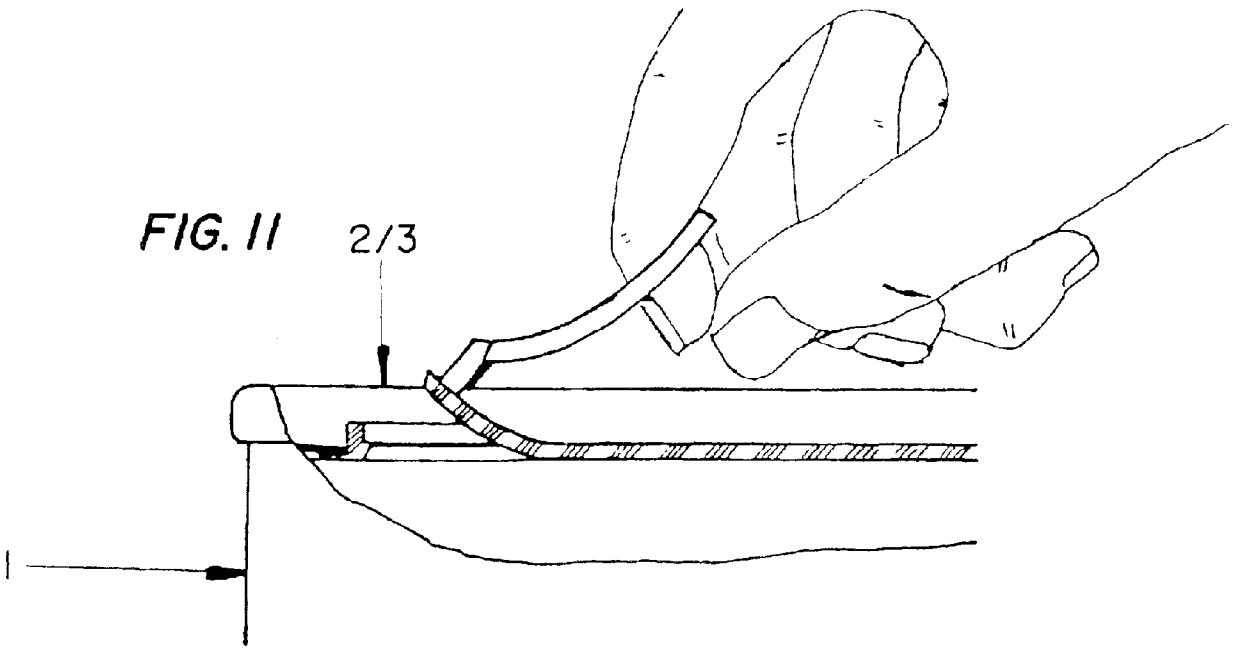
FIG. 11—shows the detail of the breaking of the seal-lid for the opening of the container for the consumption of the product.

A lid-seal for a metal container according to an embodiment of the invention is formed by bead fixing on the upper edge of the metal container (1) made of metal sheet, an assembly formed by a plastic membrane (2); and a metal ring (3).

The metal ring (3) is stamped to form a flat inner section (4) with a central circular opening (5) with the inner edge beaded and bent inward (6) and an elevation to form the lower bed (7) and ended by a peripheral border turned down and slightly inward (8) for a later beading operation.

The membrane (2) is made of injected plastic forming a peripheral portion (9) which will fit the bed (7) for beading on the border of the container (1), followed internally by a recess having a ring-like recess (10) where the flat inner section (4) with the inner edge bent inwards (6) of the metal ring (3) fits, followed internally by a perimetral ring-like reinforcement (11) and with a lower ring-shaped thin breaking line (12).

When the incorporated pulling ring (14) is pulled by the fingers, the short breaking portion (13) breaks, and then the membrane (2) breaks along the thin breaking line (12) and frees the central part (15).

What is claimed is:

1. A two-part lid-seal adapted for being fixed by beading on an upper edge of a container, comprising in combination a first part which is a unitary plastic membrane and a second part which is a metal ring;

the plastic membrane having a peripheral flange portion and a central opening portion with a narrow breaking line therebetween, a pull ring being attached to the central opening portion for breaking the plastic membrane along the breaking line, to provide an opening giving access to the interior of such container;

the metal ring having a central opening corresponding to said central opening portion in said plastic membrane and having an elevated outer section which forms an upper bed having a peripheral edge;

said plastic membrane extending continuously over an entire underside and said central opening of said metal ring:

the peripheral flange portion of the plastic membrane being shaped and located so as to nest in said upper bed of said metal ring, whereby said peripheral edge of said metal ring can be beaded on such container with the plastic flange portion forming a seal between said metal ring and such container.

2. The lid-seal of claim 1, in combination with a container, the peripheral edge of said metal ring being beaded on an upper edge of the container with said plastic flange portion forming a seal therebetween.

3. The lid-seal of claim 1, wherein said breaking line is disposed inwardly from the central opening of the metal ring, whereby a user is protected from contacting the metal ring after the central opening portion of the plastic membrane has been opened.

4. The lid-seal of claim 3, further comprising a reinforcement ring formed in the plastic membrane between the metal ring and the breaking line.

5. The lid-seal of claim 4, wherein an inner edge of said metal ring, which defines said central opening, is bent outwardly, forming a beaded edge for said central opening.

6. The lid-seal of claim 5, wherein said beaded edge of said central opening is received in a corresponding recess which opens upwardly in an upper surface of said plastic membrane.

7. The lid-seal of claim 6, wherein said recess is defined in said plastic membrane at a location outward from said reinforcement ring.

8. The lid-seal of claim 3, wherein an inner edge of said metal ring, which defines said central opening, is bent outwardly, forming a beaded edge for said central opening.

9. The lid-seal of claim 8, wherein said beaded edge of said central opening is received in a corresponding recess which opens upwardly in an upper surface of said plastic membrane.

10. A two-part lid-seal adapted for being fixed by beading on an upper edge of a container, comprising in combination a first part which is a unitary plastic membrane and a second part which is a metal ring;

the plastic membrane having a peripheral flange portion and a central opening portion with a narrow breaking line therebetween, a pull ring being attached to the central opening portion for breaking the plastic membrane along the breaking line, to provide an opening giving access to the interior of such container;

the metal ring having a central opening corresponding to said central opening portion in said plastic membrane and having an elevated outer section which forms an upper bed having a peripheral edge;

whereby said peripheral edge of said metal ring can be beaded on such container;

wherein an inner edge of said metal ring, which defines said central opening, is bent outwardly, forming a beaded edge for said central opening; and wherein said beaded edge of said central opening is received in a corresponding recess which opens upwardly in an upper surface of said plastic membrane.

11. A lid-seal of claim 10, in combination with a container, the peripheral edge of said metal ring being beaded on an upper edge of the container.

* * * * *